US006871436B2

(12) United States Patent
Chen-Li et al.

(10) Patent No.: US 6,871,436 B2
(45) Date of Patent: Mar. 29, 2005

(54) FILAMENT FASTENING SYSTEM TAG

(76) Inventors: Susannah Chen-Li, 661 S. Bradshawe Ave., Monterey Park, CA (US) 91754; Josiah To Sang Li, 661 S. Bradshawe Ave., Monterey Park, CA (US) 91754

( * ) Notice: Subject to any disclaimer, the term of this patent is extended or adjusted under 35 U.S.C. 154(b) by 313 days.

(21) Appl. No.: 10/137,487

(22) Filed: Apr. 30, 2002

(65) Prior Publication Data

US 2003/0200681 A1 Oct. 30, 2003

(51) Int. Cl.[7] ..... G09F 3/12
(52) U.S. Cl. ..... 40/668; 40/662
(58) Field of Search ..... 40/299.01, 300, 40/301, 662, 668, 663, 625, 27; 206/807, 343

(56) References Cited

U.S. PATENT DOCUMENTS

| | | | | | |
|---|---|---|---|---|---|
| 1,359,951 | A | | 11/1920 | Behrman | |
| 1,631,954 | A | * | 6/1927 | Behrman | 40/662 |
| 1,640,196 | A | * | 8/1927 | Kondolf | 40/662 |
| 2,517,376 | A | | 8/1950 | Artztet et al. | |
| 4,263,730 | A | | 4/1981 | Clements | |
| 4,635,389 | A | * | 1/1987 | Oudelette | 40/301 |
| 5,125,700 | A | | 6/1992 | Fattori | |
| 5,546,688 | A | | 8/1996 | Merser | |
| 5,568,951 | A | | 10/1996 | Morgan | |
| 5,762,386 | A | | 6/1998 | Fuehrer | |
| 5,799,425 | A | | 9/1998 | Merser et al. | |
| 5,945,909 | A | * | 8/1999 | Kolton | 340/572.1 |
| 6,128,932 | A | | 10/2000 | Mainetti et al. | |

* cited by examiner

*Primary Examiner*—Gary C. Hoge
(74) *Attorney, Agent, or Firm*—Freilich, Hornbaker & Rosen

(57) ABSTRACT

A single use product tag configured for use with a filament fastener to attach the tag to a manufactured article, e.g., a garment. The tag comprises a housing having an access channel leading to an interior cavity. The crossbar end of a filament fastener can be inserted through the access channel for placement into the interior cavity. A closure device is mounted in the tag housing for movement from an open position to a sealing position to block the access channel so as to prevent removal of the crossbar end of the fastener and prevent the insertion of another fastener.

11 Claims, 3 Drawing Sheets

FILAMENT FASTENING SYSTEM TAG

FIELD OF THE INVENTION

This invention relates generally to filament fastening systems for attaching product tags to manufactured articles, e.g., garments. More particularly, this invention relates to a tag construction and method of use that allows a filament fastener to be easily initially attached to a tag but prevents subsequent detachment of the fastener as well as preventing attachment of another fastener to the tag.

BACKGROUND OF THE INVENTION

Filament fastening systems are well known for conveniently attaching product tags (carrying, for example, bar code, price, brand, etc. information) to manufactured articles, e.g., as clothing articles. Such systems are readily commercially available and are widely discussed in the literature; e.g., see Avery Dennison Fastener Division web site. Such systems are characterized by the use of fastener comprising a flexible filament having a cross bar on a first end and a cross element, e.g., bar, paddle, hook, etc on a second end. An installation tool typically having a slotted hollow insertion needle is generally used to insert the filament first end through both the manufactured article and a product tag to attach the tag to the article. Exemplary U.S. Pat. No. 5,799,425 issued Sep. 1, 1998, describes the practice of attaching tags to articles as follows:

The practice of attaching tags to articles of clothing and the like by means of plastic fasteners is well known. One such type of fastener comprises a filament having a cross-bar at one end and a paddle at the other end. Such tags typically comprise a generally-rectangular sheet of tagstock or tagboard provided with a hole, the tag typically being attached to the article of clothing by inserting the cross-bar end of the plastic fastener first through the hole in the tag and then through the article of clothing using a device commonly referred to as a tagger gun. As is known, a tagger gun generally includes a hollow needle through which the fastener is dispensed and a mechanism for pushing the fastener out through the hollow needle. With the cross-bar end of the fastener thus attached to the article, the paddle end of the fastener serves to keep the tag from being pulled off the filament portion of the fastener. Information relating to the name of the manufacturer, name of the retailer, the price of the article, or the like is typically printed on the tag. Another type of fastener often used to attach a tag to an article of clothing comprises a filament having a crossbar at each end. Examples of tagger guns may be found in U.S. Pat. No. 3,103,666 to A. R. Bone and U.S. Pat. No. 5,024,365 to D. L. Borque, which patents are incorporated herein by reference.

One problem that has arisen with the use of such tags, particularly in connection with the sale of articles of clothing, is that certain unscrupulous consumers have made a practice of purchasing an expensive or unusual article of clothing, removing those tags attached to the garment (the tags often being conspicuously placed on the article), wearing the article of clothing once or twice, and then returning the article of clothing to the retailer for a refund. Because of the administrative difficulties associated with determining which consumers have legitimate reasons for returning their articles of clothing and which consumers are looking for refunds for worn articles of clothing, many retailers are effectively forced to issue refunds to all those who request such. As can readily be appreciated, this can result in considerable losses for the retailer as many of the worn and returned articles of clothing are no longer in new condition and cannot be re-sold for their original prices.

In view of the aforedescribed practice of "unscrupulous consumers", U.S. Pat. No. 5,799,425 describes a tag construction that makes it difficult for a consumer to detach and subsequently manually reattach a tag to an article without leaving evidence of tampering.

Although the tag construction described in U.S. Pat. No. 5,799,425 appears to considerably increase the difficulty of manually reattaching a tag, it does not appear that it would significantly impede a consumer equipped with a suitable installation tool, i.e., tagger gun, which tools can now be readily acquired by consumers.

SUMMARY OF THE INVENTION

Accordingly, the present invention is directed to an improved tag construction and method of use that allows a filament fastener to be easily initially attached to the tag and prevents the attachment of a subsequent fastener.

More particularly, the present invention relates to a single use tag having an access channel for receiving therethrough a crossbar end of a filament fastener. The tag incorporates a closure device mounted for movement between an open position permitting insertion of a fastener crossbar end through the access channel and a sealing position for preventing the crossbar end being inserted through the access channel.

In accordance with a preferred embodiment, the closure device is able to move from said open position to said sealing position but is prevented from moving from the sealing position to the open position. Thus, after the crossbar end of an initial fastener is inserted into the tag access channel and the closure device is moved to the sealing position, a user is prevented both from removing the initial fastener and from attaching a subsequent fastener.

In accordance with the preferred embodiment, movement of the closure device from the sealing position to the open position is prevented by a mechanism, which permanently latches the closure device in the sealing position.

In a preferred embodiment of the invention, the tag comprises a body, or housing, having an internal wall enveloping an interior cavity. The access channel extends through the tag body wall to the interior cavity. The access channel is preferably dimensioned to receive a conventional installation tool needle for inserting the crossbar end of a fastener into the interior cavity. When the needle is withdrawn, the crossbar remains in the cavity with the filament portion of the fastener extending therefrom through the access channel. The closure device is then moved to its sealing position to capture the initial fastener and prevent the subsequent insertion of a fastener crossbar through the access channel.

The closure device is preferably mounted in the tag body for sliding movement between the open position and the sealing position. A pawl carried by the closure device is positioned to engage a recess in the tag body when the device moves to the sealing position. The recess captures the pawl to latch the closure device in the sealing position and thus prevent the insertion of a subsequent fastener through the access channel.

The tag body is preferably configured with flat outer faces appropriate for bearing human and/or machine readable product information.

Additional aspects and advantages of the invention are discussed in the following description wherein reference is made to the accompanying drawings which form a part thereof and in which a specific embodiment is shown, by way of illustration, for practicing the invention. The embodiment will be described in sufficient detail to enable one skilled in the art to practice the invention, but it should be understood that other embodiments may be utilized and structural changes may be made without departing from the intended scope of the invention as defined by the appended claims.

DETAILED DESCRIPTION

Figure 1:
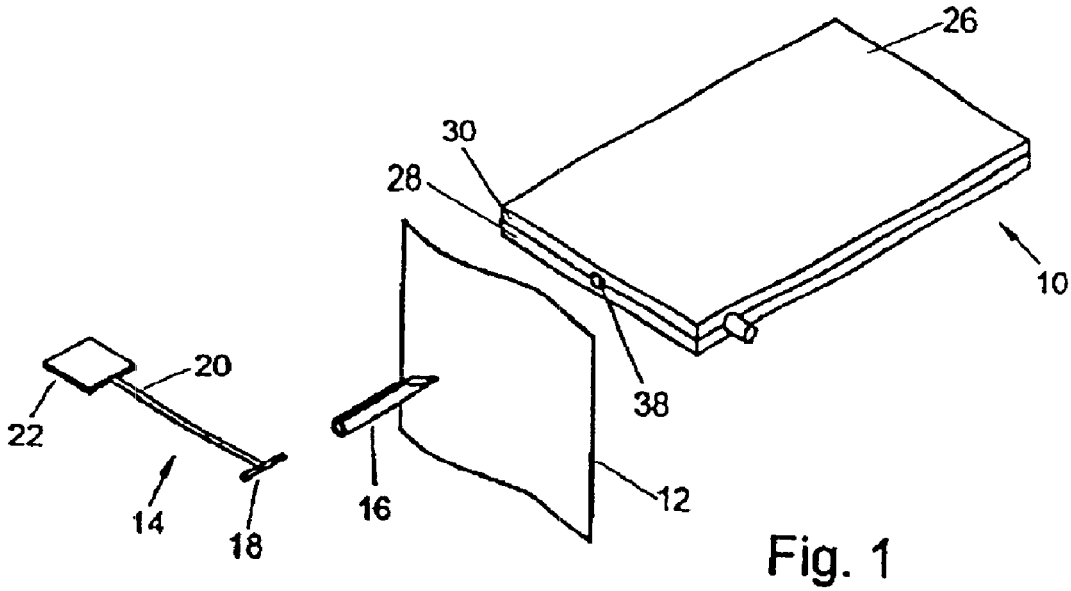
FIG. 1 is an isometric view depicting an exemplary tag in accordance with the present invention for receiving a crossbar end of a filament fastener.

Attention is initially directed to FIG. 1 which depicts a product tag 10 in accordance with the present invention useful for bearing human and/or machine readable product information such as bar code, price, brand, etc. The product tag 10 is intended for attachment to a manufactured article, e.g., an article of clothing 12, by a conventional flexible filament fastener 14. The tag 10 in accordance with the invention is particularly configured to enable a fastener 14 to be easily initially attached to the tag but to then prevent detachment and subsequent reattachment of the same or different fastener to the tag.

FIG. 1 schematically depicts a hollow needle 16 of a conventional installation tool (or tagger gun) which is used to insert the crossbar end 18 of the fastener 14 through the article 12 for attachment to the tag 10. The fastener 14 is comprised of an elongate flexible filament 20 having the crossbar 18 formed on a first end thereof extending essentially perpendicularly to the elongation of the filament 20. A cross element 22, e.g., a paddle, is formed on a second end of the filament 20.

Figure 2:
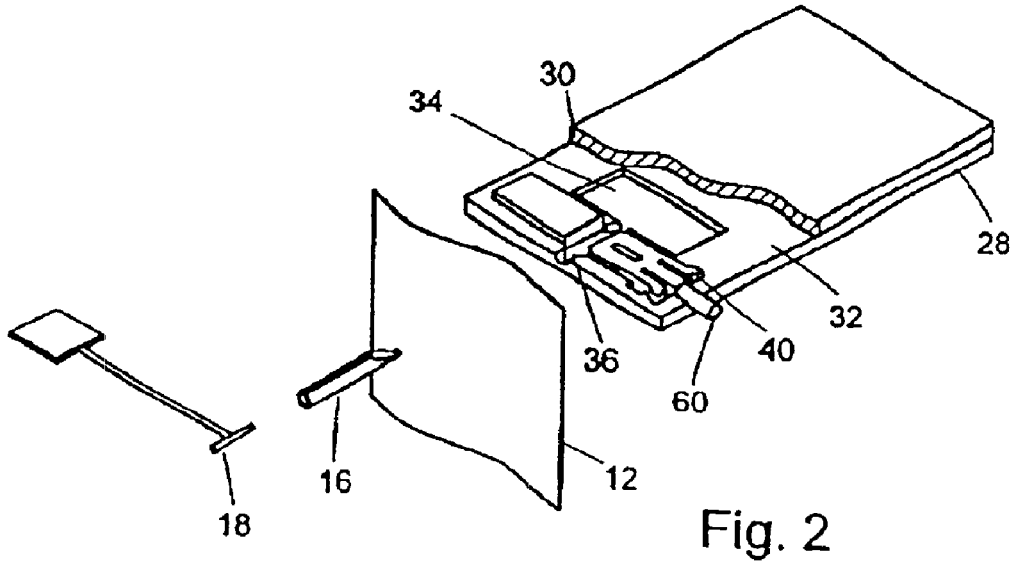
FIG. 2 is an isometric view similar to FIG. 1 but showing the cover layer of the tag broken away to reveal a preferred interior construction.

A product tag 10 in accordance with the present invention is comprised of a tag body or housing 26 which is preferably formed of two thin superposed plastic layers; i.e., a base layer 28 and a cover layer 30. FIG. 2 depicts the cover layer 30 cut away to reveal the inner face 32 of the base layer 28. The layer 28 comprises a wall which on its inner face 32 defines an interior cavity 34. The layer 28 also defines an interior access channel 36 having an access, or entrance, opening 38. The layers 28, 30 are preferably molded and configured so that their opposed inner faces cooperatively form the interior access channel 36 and cavity 34 as well as other interior passageways, recess, etc. to be discussed hereinafter.

FIGS. 1 and 2 depict an exemplary installation tool needle 16 intended to insert the crossbar end 18 of a filament fastener 14 through the article 12, and through the access opening 38 and channel 36 into the interior cavity 34.

In accordance with the present invention, a closure device 40 is mounted between layers 28 and 30 for movement between (1) an open position (FIG. 2) permitting insertion of the needle 16 through the access channel 36 and (2) a sealing position which closes the channel 36 and blocks insertion of the needle 16. In the preferred embodiment depicted in the figures, the closure device 40 is mounted for linear sliding movement, as will be described hereinafter, from the open position to the sealing position. It should be understood, however, that in alternative embodiments of the invention, the closure device can be mounted to exhibit other types of movement between an open and a sealing position.

Figure 3:
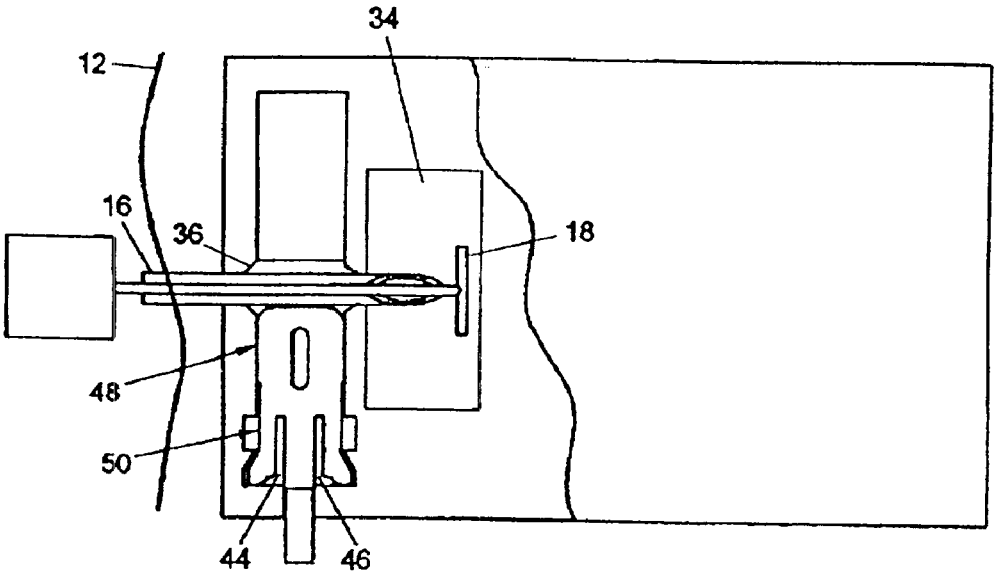
FIG. 3 is a schematic plan view depicting the utilization of an installation tool needle for inserting the crossbar end of a filament fastener through an access channel in the tag body and into an interior cavity.
Figure 4A:
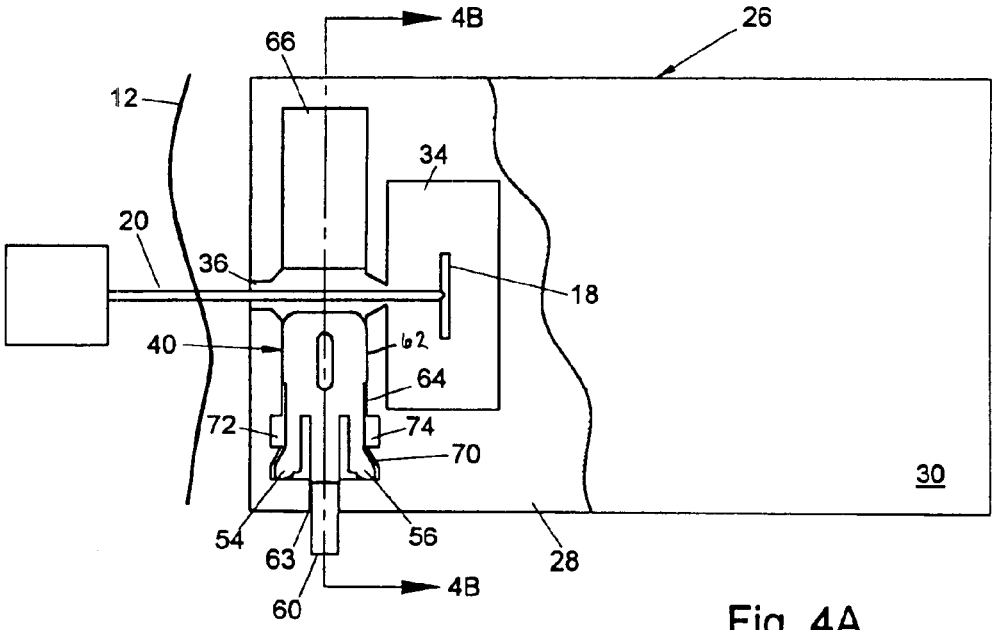
FIG. 4A is a schematic plan view similar to FIG. 3 showing the filament fastener crossbar end within the interior cavity after withdrawal of the installation tool needle and FIG. 4B is a sectional view taken substantially along the plane 4B—4B of FIG. 4A.
Figure 4B:
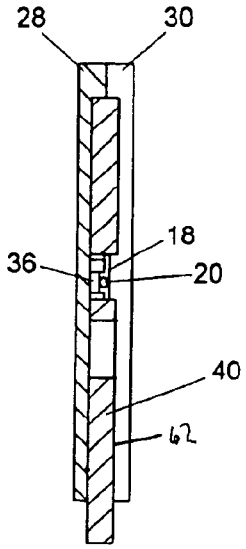

Attention is now directed to FIG. 3, which depicts the installation tool needle 16 extending through the article 12 and through the access channel 36 to place the crossbar 18 in the interior cavity 34. FIG. 4A is identical to FIG. 3 except that the needle 16 has been removed leaving the filament 20 extending through the article 12 and through the access channel 36 and terminating at the crossbar end 18 captured in the cavity 34. The closure device 40 preferably comprises a thin plastic body 42 that includes slots 44 and 46. The slots 44, 46 essentially partition the closure device body 42 into a head portion 48 having a forward edge 49 and a tail portion 50 comprising resilient depending legs 51, 52. The legs 51, 52 respectively terminate in outwardly projecting feet or pawls 54, 56. The tail portion 50 further defines a control actuator stem 60.

Figure 5:
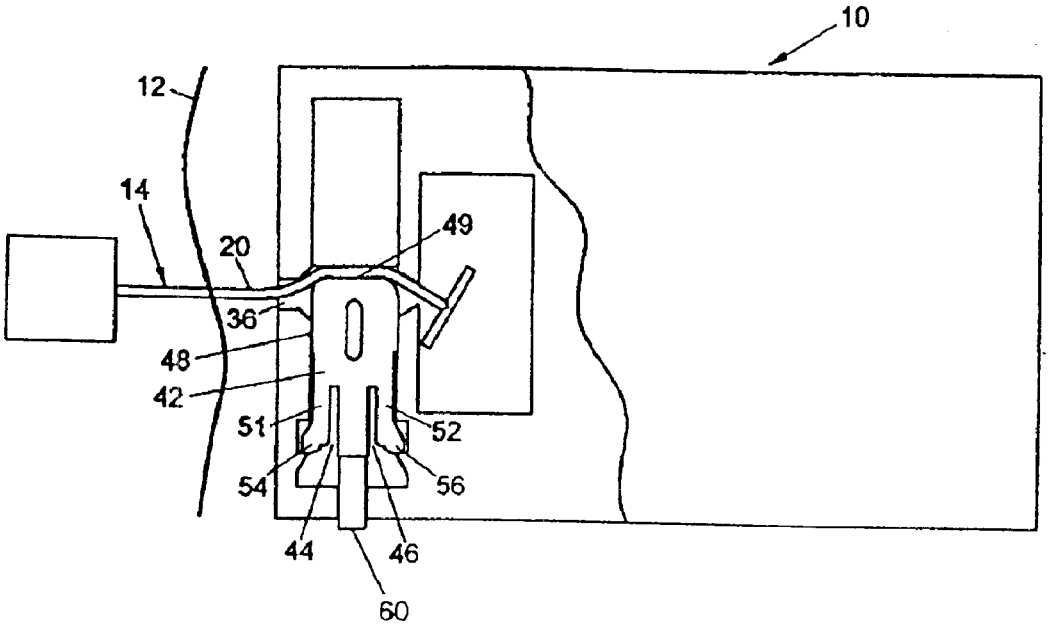
FIG. 5 is a schematic plan view similar to FIGS. 3 and 4A showing a closure device latched in a sealing position to close the tag body access channel.

In the preferred embodiment depicted, the closure device 40 is mounted for linear movement in passageway 62, oriented substantially perpendicular to the access channel 36, from the open position shown in FIG. 4A to the sealing position shown in FIG. 5. The passageway 62 is preferably formed by aligned recesses in the opposed inner faces of layers 28 and 30.

Note in FIG. 4A that the actuator stem 60 extends from the body tail portion 50 through an aperture 63 extending through the tag body wall. By pressing the stem 60 toward the access channel 36, the closure device body 42 will slide within passageway 62 toward fixed block 66. As the closure device body 42 slides toward the access channel 36, the sidewalls of passageway 62 at 70 will initially compress the closure device resilient legs 51, 52 toward one another. As the closure device body 42 moves further along the passageway 62 toward the access channel, the pawls 54, 56 carried by the compressed resilient legs 50, 52 will snap outwardly into recesses 72, 74 formed in the passageway sidewalls. This action will latch the closure device forward edge 49 against fixed block 66 in the sealing position depicted in FIG. 5 to thus lock the filament 20 between the closure device and the fixed block 66. As a consequence, the captured filament 20 is prevented from being detached from the tag 10.

In normal use, a user will remove the tag 10 from the article 12 by cutting the filament 20 outside the tag, leaving the fastener crossbar end within the interior cavity 34. The user is then prevented from reattaching the tag to the article 20 because the closure device 40 latched in the sealing position of FIG. 5 prevents reinsertion of a needle and/or filament fastener through the access channel 36.

The tag body layers 28 and 30 can be formed of any rigid or semi-rigid material. However, it is advantageous, primarily for cost reasons, to form the layers 28, 30 from an appropriate plastic material. As previously mentioned, the layers are preferably molded so that recesses on their respective inner faces cooperate to form the interior access channel 36, interior cavity 34, etc. The outer faces of the respective layers 28, 30 are preferably flat, as shown, and suitable for bearing human and/or machine-readable information. Also, the tag body can be formed of transparent material so that information formed between the layers 28, 30 would be externally visible. Additionally, the tag is well suited for carrying information, which can be remotely read, e.g., via radio frequency and/or magnetic energy coupling. More particularly, a known radio frequency identification device (RFID) chip can be carried by the tag body 26.

From the foregoing, it should now be apparent that applicants have disclosed herein a tag construction and method of use that allows a filament fastener to be easily initially attached to the tag but prevents the attachment of a subsequent fastener. Although applicants have described a specific exemplary embodiment, it should be understood that various alternatives and modifications may readily occur to those skilled in the art, that fall within the spirit and scope of the invention as defined by the appended claims.

What is claimed is:

1. A tag configured for attachment to a filament fastener comprising:

a housing;

an interior cavity in said housing;

an opening in said housing communicating with said interior cavity, said opening being dimensioned to allow a crossbar end of an initial filament fastener to be inserted therethrough to place said crossbar in said cavity; and a closure device carried by said housing for sealing said opening to prevent insertion of a subsequent filament fastener, said closure device being mounted for movement from an open position to a sealing position and including a latch for latching said closure device in said sealing position.

2. The tag of claim 1 wherein said housing includes a substantially flat outer face for bearing human and/or machine readable product information.

3. A tag for use with a fastener including a filament having a crossbar formed on a first end thereof, said tag comprising:

a tag body including a wall enveloping an interior cavity;

an access channel extending through said wall and communicating with said interior cavity for permitting said filament first end to be inserted therethrough to place said crossbar in said cavity; and a closure device mounted for movement between an open position permitting insertion of said filament first end through said access channel and a sealing position for preventing insertion of said filament first end through said access channel.

4. The tag of claim 3 for use in combination with a fastener installation tool having a fastener dispensing needle; and wherein said access channel is dimensioned to receive said dispensing needle.

5. The tag of claim 3 including:

means for moving said closure device from said open to said sealing position.

6. The tag of claim 3 including:

means for preventing movement of said closure device from said sealing position to said open position.

7. The tag of claim 6 wherein said means for preventing movement includes a recess in said tag body and a pawl carried by said closure device for engagement with said recess.

8. The tag of claim 3 wherein said closure device is mounted for linear movement substantially perpendicular to said channel.

9. The tag of claim 3 wherein said housing includes a substantially flat outer face for bearing human and/or machine readable product information.

10. A method of attaching a tag to an article so as to prevent detachment and subsequent reattachment of the tag, said method including:

providing a tag body having an interior cavity and an access opening communicating with said cavity;

providing a filament fastener having a cross bar formed on a first end thereof;

inserting said fastener first end through said access opening to place said cross bar from said cavity; and subsequently closing said access opening to prevent removal of said cross bar from said cavity and insertion of an alternative fastener into said access opening, and wherein said step of closing said access opening includes moving a closure device into a sealing position to block said opening.

11. The method of claim 10 including the further step of latching said closure device in said sealing position.

* * * * *